US006035455A

United States Patent [19]

Rankovic

[11] Patent Number: 6,035,455

[45] Date of Patent: Mar. 14, 2000

[54] PORTABLE POWER PLUMBING PLUNGER

[75] Inventor: Radoslav Sasha Rankovic, Toronto, Canada

[73] Assignee: Jake Bielas, Toronto, Canada

[21] Appl. No.: 09/231,952

[22] Filed: Jan. 15, 1999

[51] Int. Cl.[7] ..... E03D 9/00

[52] U.S. Cl. ..... 4/255.03; 4/255.04

[58] Field of Search ..... 4/255.01–255.06, 4/255.12

[56] References Cited

U.S. PATENT DOCUMENTS

| | | | |
|---|---|---|---|
| 1,944,526 | 3/1934 | McCloskey | 4/255.03 |
| 2,187,043 | 1/1940 | MacMillan | 4/255.02 X |
| 4,733,414 | 3/1988 | Wilkes | 4/255.03 |
| 5,020,166 | 6/1991 | Davenport | 4/255.06 X |

*Primary Examiner*—Charles E. Phillips

*Attorney, Agent, or Firm*—David W. Wong

[57] ABSTRACT

The portable power plunger is for unclogging blocked drains in sinks, toilets, bath tubs and the like. The plunger has a main body having a reciprocating pump with a removable attachment mounted at its outlet lower end which is adapted to cover intimately over the waste water drain of a sink, toilet, or bath tub. The drain may be unclogged by operating the pump to dislodge the blockage and to dispose of it down the sewer. The pump is provided with a substantial back flow preventor such that the dirty water in the drain would not back into the pump to contaminate the latter. An integral injector pipe is also provided on the plunger. The injector pipe extends into an interior compartment at the lower part of the housing between the back flow preventor and the outlet, and it is attached to a pneumatic pressure source or pressurized water supply. The pneumatic pressure or pressurized water provides additional pressure to unclog the blockage in the drain or for drawing dirty water out from the drain.

10 Claims, 2 Drawing Sheets

PORTABLE POWER PLUMBING PLUNGER

BACKGROUND OF THE INVENTION

This invention relates to a portable power plunger and particularly relates to a plunger which is operative to provide high power for unclogging a blocked drain in sinks, toilets, bath tubs and the like.

Plungers are commonly used for unclogging a blocked drain. The basic plumbing plunger consists of a rubber suction cup or a hollow bell-shaped element attached to an elongated handle. The suction cup or bell-shaped element is pressed over the opening of the drain with a rapid pumping action to create the force required to loosen the blockage. Such simple plungers are not effective for unclogging severe blockage in a drain. For clearing severe blockage, a plumbing cable commonly called a snake may be inserted into the drain to remove the blockage. Plumbing snakes are messy and difficult to use. Alternatively, a power plunger may be employed. A power plunger is shown in U.S. Pat. No. 1,861,899 to J. L. MacMillan in which the plunger includes a hand pump having a rounded outlet lower end for engaging the waste opening of a drain. The pump may be operated for providing the force required to remove the obstruction in the drain. The pump is also provided with an end piece which has a tubular extension at its side. A guide tube, connected to a water supply faucet, can be slidably inserted through the tubular extension into the end piece and extending into the drain until it reaches the blockage to wash the loosen obstruction down the sewer. The main drawback of such power plunger is that there is no provision to prevent the foul water in the drain from backing into the pump housing to contaminate its interior. The device is awkward to operate when the drain is remotely located from the water faucet. In such instance, the operator must run back and forth between the faucet and the clogged drain to adjust the faucet valve during operation in order to obtain the suitable amount of water from the faucet. Also, since the guide tube is only slidably inserted through the side tubular extension, it could easily dislodge from the pump during the vigorous pumping action during operation. Furthermore, since the device must be held firmly pressed against the waste opening by the operator during operation, it would not be possible for the operator to leave the device to walk to the remote faucet to adjust its valve. Doing so would invariably result in the pressurized water from the water supply jetting uncontrollably out of the device to the surrounding area of the drain equipment. Such device is also not suitable for removing a blockage in a toilet, since there is no provision for engaging a toilet drain. U.S. Pat. No. 4,847,923 to C. Huang shows another portable power plunger which is provided with a check valve to prevent the foul water from backing into the pump so as to prevent contamination of the pump. However, the check valve therein is insubstantial in structure such that it would malfunction or clog up easily with particles in the foul water of the drain or break down after a short period of use. Moreover, its outlet is provided with a duct extending beyond a flow guide disc which is intended to cover over the drain opening. Such duct extension would not fit over the majority of the drain opening of common sinks and it could not cover the drain of a toilet to prevent the foul water of the toilet from splashing out therefrom during operation. The Huang device is also provided with a coupling at the handle of the piston stem of the pump so that pressurized water may be injected through the hollow stem into the drain. Such construction is highly impractical, since the connecting tubing would easily dislodge from the coupling at the handle or break at the connection during the vigorous pumping action of the stem during operation.

SUMMARY OF THE INVENTION

It is a principal object of the present invention to provide a versatile portable power plunger which is operative effectively to remove an obstruction in a clogged drain of a sink, toilet or bath tub and the like.

It is another object of the present to provide a portable power plunger in which the control of the supplementary pressurized water is located at the device so that it is not necessary for the operator to run back and forth between the water faucet and the clogged drain, and the device may be firmly held and pressed against the waste opening of the drain while the pressurized water is applied.

It is yet another object of the present invention to provide a portable power plunger having a substantial and reliable back flow preventor which effectively prevents any foul water from the clogged drain or toilet from backing into the pump.

Briefly, the portable power plunger of the present invention comprises a cylindrical housing having a piston located therein and mounted to an elongated stem extending outwards through an upper cap of the housing. An air release valve is formed on the upper cap and is adapted to release air from the upper portion of the housing when the piston is operated in an up and down reciprocating fashion. An outlet is formed at a lower end of the housing. An attachment means is removably mounted to the outlet of the housing. The attachment means is operative to engage intimately with a waste opening of a clogged drain. A back flow preventor member is mounted in the housing and located below the piston and is adapted to prevent foul water in the drain from backing into the pump housing. An interior compartment is provided between the back flow preventor member and the outlet. An integral injector member is provided at the housing. The injector member has a lower tubular portion extending into the interior compartment, and it has an upper tubular portion extending outside the housing. A water control valve is mounted to the upper tubular portion of the injector member. A coupling member is provided at the water control valve and it is adapted to connect the water control valve to a pressurized water supply for injecting pressurized water into the interior compartment and the clogged drain with the operation of the water control valve.

DESCRIPTION OF THE DRAWINGS

Other objects of this invention will appear in the following description and the appended claims, reference being made to the accompanying drawings in which

DETAILED DESCRIPTION OF THE PREFERRED EMBODIMENTS

Figure 1:
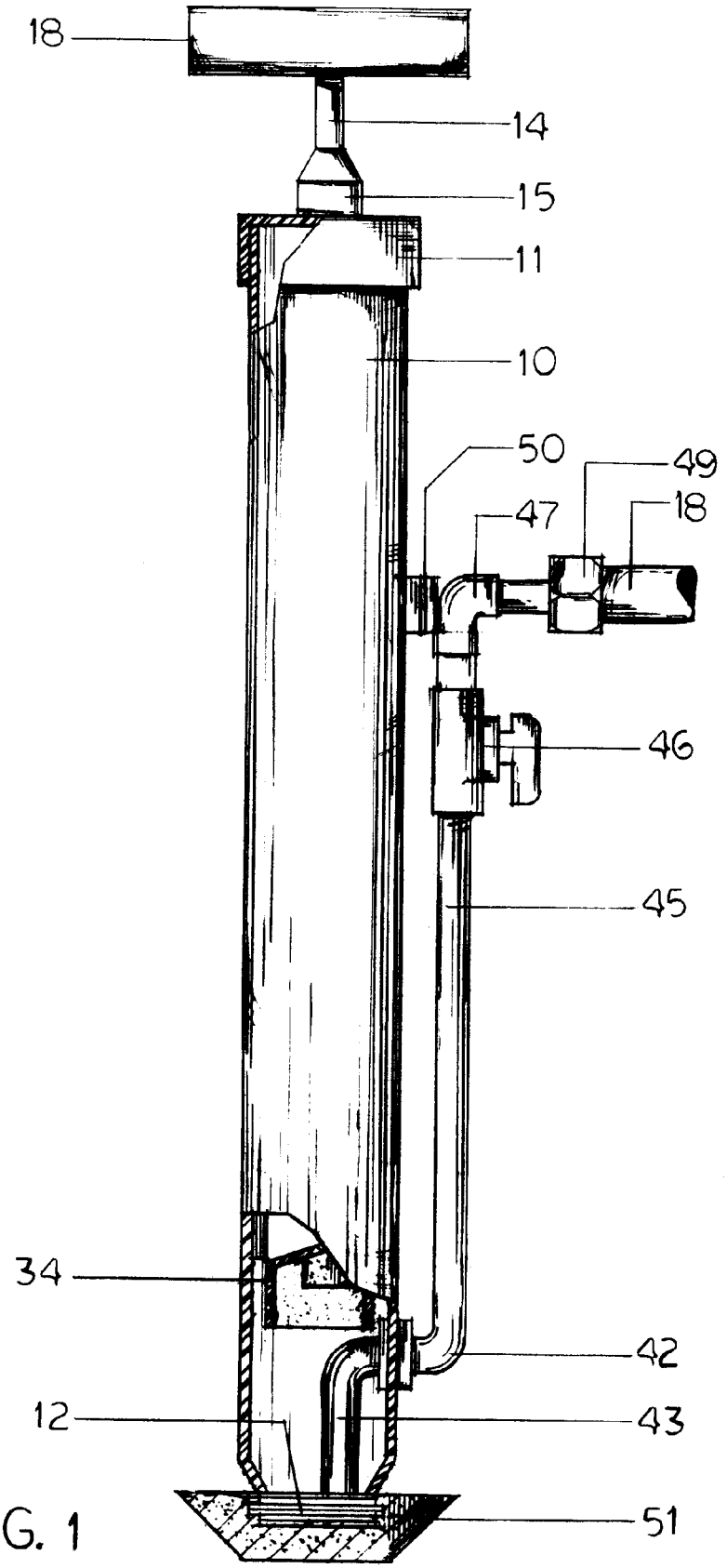
FIG. 1 is a perspective side elevation view of the portable power plunger according to the present invention having a partial cut view showing the interior compartment therein.

With reference to the drawings wherein like reference numerals designate corresponding parts in the several views, the portable power plunger of the present invention has a cylindrical housing 10 with a cap 11 mounted at its upper end and an outlet 12 located at its lower end. The cap 11 may be threadingly mounted to the housing for easy assembly and disassembly of the plunger. A piston 13 is slidably located within the housing 10 and is mounted to the lower end of an elongated stem 14. The upper end of the stem 14 extends outside the cap 11 through a bushing 15 mounted at the central opening 16 formed in the cap 11. The top end of the stem 14 may be provided with a cross bar 17 for mounting a handle 18 thereto. It would be appreciated by those skilled in the art that the handle 18 may be mounted to the top end of the stem 14 by other conventional means such as by threadingly engaging a straight stem 14 to a threaded opening formed in the handle 18. The piston 13 may be operated slidably up and down the housing 10 in a reciprocating manner with the handle 18. An air valve 19 is formed in the cap 11 such that outside air may enter the pump and also the air within the pump may escape therefrom when the piston 13 is operated in a reciprocating manner. A plastic oring is mounted below the bushing 15 to provide an intimate air-tight seal between the bushing and the stem 14 so that air would not leak through the central opening 15 during the operation of the piston 13.

The piston 13 is inverted cup-shaped and may be made of a plastic material such as ABS or a rubberized material, and it is mounted to the lower end of the stem 14 by nuts 21 and 22. A rubber washer 23 is provided on top of the upper nut 21 so as to serve as a shock absorber to cushion the bumping force of the piston 13 impinging on the o-ring 20 when the piston 13 is pulled to its upper most position. A stop shelf 24 is formed on the interior side wall of the housing 10 to provide an abutment for the piston 13 when it is pushed to its lowermost position.

Figure 2:
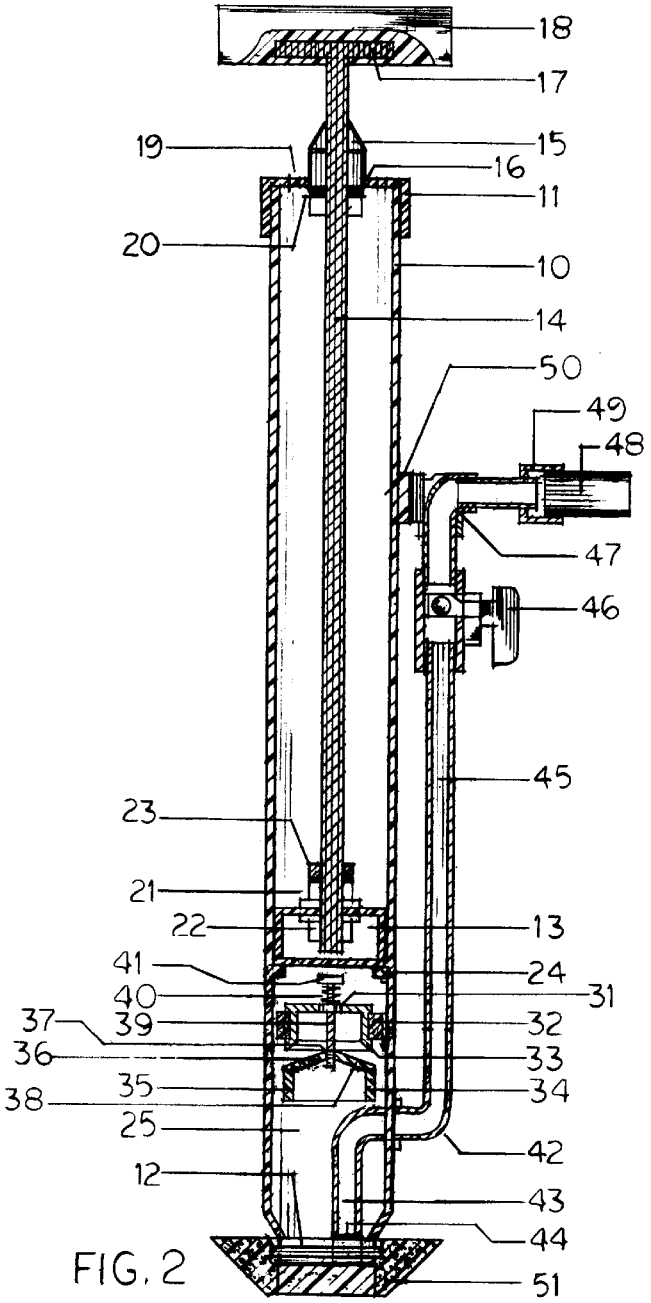
FIG. 2 is a side cross sectional elevation view thereof.

An interior compartment 25 is provided between the piston 13 and the outlet 12 in the housing 10. A back flow preventor assembly 26 is mounted fixedly within the interior compartment and located just below the piston 13. The back flow preventor assembly 26 has a cylindrical main body 27 having a top cross bar 28 which divides the top opening of the main body 27 into two half circular openings 29 and 30. A retaining opening 31 is formed at the center of the cross bar 28. A circular rubber seal 32 is mounted around the main body 27, which forms a tight seal between the main body 27 and the housing 10. The bottom edge 33 of the main body 27 is bevelled and slanted downwardly outwardly as best shown in FIG. 2. A stop plug member 34 is located below the main body 27. The stop plug member 34 has a cylindrical lower portion 35 and conical closed top portion 36 having an apex 37. The surface of the conical surface 38 has the same sloping gradient as the bevelled bottom edge 33 of the main body 27 such that the conical top portion 36 may engage with the bottom opening of the main body 27 to tightly close the bottom opening. The stop plug member 34 is mounted to the main body 27 by a retaining pin 39 which extends slidably through the center opening 31 of the cross bar 28 to secure to the apex 37 of the stop plug member 34. The top of the conical top portion 36 is normally maintained in abutment with the bottom of the main body 27 by a tension spring 40 mounted on the retaining pin 39 and located between the cross bar 28 and the head 41 of the retaining pin 39.

An injector 42 is integrally formed on the side of the housing 10. The injector 42 has an integral lower tubular portion 43 extending into the interior compartment 25 and lower end 44 of the lower tubular portion 43 may be located adjacent to or flush with the outlet 12 of the housing 10. The injector 42 has a vertical tubular portion 45 extending upwardly along the outer side wall the housing 10. A control valve 46 is mounted at the upper end of the vertical tubular portion 43. An L-shaped coupling 47 is provided at the control valve 46 for mounting a flexible hose 4 thereto with a retaining cap 49 for connection to a water faucet or a pneumatic source. The L-shaped coupling 47 may be securely mounted to the outer side wall of the housing 10 with a brace 50 to maintain the vertical tubular portion 43 firmly mounted to the outer side wall of the housing 10. Alternatively, the brace 50 may be provided at the vertical tubular portion 43 directly or provided at the control valve 46.

Figure 5:
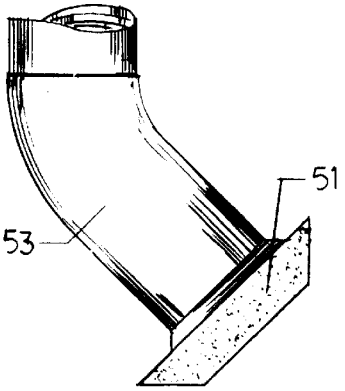
FIG. 5 is a side elevation view of a 45 degree angled elbow coupling for attaching the spud attachment to the outlet of the device for engaging a toilet drain of another design.
Figure 4:
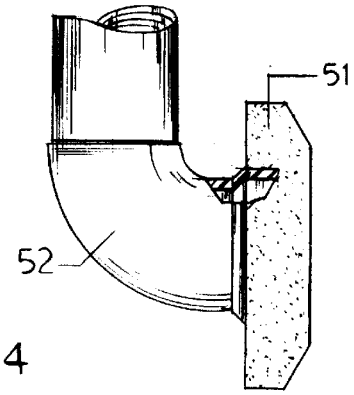
FIG. 4 is a side elevation view of a right-angled elbow coupling for attaching the spud attachment to the outlet of the device for engaging a toilet drain.
Figure 3:
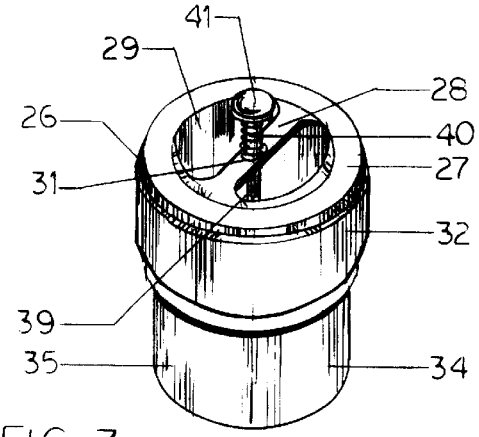
FIG. 3 is an isolated top elevation perspective view of the back flow preventor assembly therein.

A spud attachment 51 is removably and interchangeably mounted at the outlet 12. The spud attachment 51 may be made of rubber and has a frusto-conical shape adapted to engage tightly with the waste water opening of a clogged drain or a toilet. The spud attachment 51 may be mounted to the outlet 12 through various selected angled elbow couplings such as a right-angled elbow coupling 52 and a 45 degree angled elbow coupling 53 shown in FIGS. 4 and 5 respectively to facilitate close engagement with toilet drain openings of various designs.

In operation, the operator holds the plunger and pressed the spud attachment 51 over the drain opening of a clogged drain with the flexible hose connected to a pressurized water supply or pneumatic source, and the piston 13 is operated in a reciprocating manner. When the piston 13 is pushed downwards, it produces pressurized air which forces the stop plug member 34 to move against the retaining force of the tension spring 40 away from the bottom opening of the main body 27 such that the pressurized air passes through the space thus formed between the stop plug member 34 and the main body 27 into clogged drain through the interior compartment 25. When the piston 13 is pulled upwards in the reciprocating operation, water in the interior compartment 25 would force the stop plug member 34 to engage intimately and tightly with the bottom opening of the main body 27 of the back flow preventor assembly to prevent the water from backing into the housing 10 to prevent the foul water from the drain from contaminating the device. After the piston 13 has been operated repeatedly in a reciprocating manner, a high volume of pressurized air is thus produced in the clogged drain to loosen the obstruction. The loosening of the obstruction may be confirmed by slowly operating the control valve 46 to feed the pressurized water through the injector 42 into the drain. If water flows smoothly therethrough, the obstruction has been removed. If water does not flow therethrough, the piston 13 may be operated against until the obstruction is loosen. The pressurized water serve both as a supplementary pressure source to loosen the obstruction as well as the means for carrying the loosened obstruction away down the sewer.

While the present invention has been shown and described in the preferred embodiment thereof, it will be apparent that various modifications can be made therein without departing from the spirit or essential attributes thereof, and it is desired therefore that only such limitations be placed thereon as are imposed by the appended claims.

I claim:

1. A portable power plunger comprising:

a cylindrical housing having a piston slidably located therein and mounted to an elongated solid stem extending outward through an upper cap of said housing, air release valve means formed in said upper cap and adapted to release air from said housing when said piston is operated in an up and down reciprocating fashion, an outlet formed at a lower end of said housing, attachment means adapted to be removably mounted to said outlet and operative to engage with a waste water opening of a clogged drain, a back flow preventor assembly mounted in said housing and located below said piston and adapted to prevent foul water from said drain to enter into said housing, said back flow preventor assembly including a cylindrical main body fixedly mounted in said housing, said main body having a bottom opening with a bevelled bottom edge, and a stop plug member located below said main body, said stop plug member having a conical top portion with a sloping top surface, and said sloping top surface and said bevelled bottom edge having an equal sloping gradient and adapted to engage one another in an intimate contact.

2. A portable power plunger according to claim 1 wherein said main body has a transverse top cross bar with a center opening formed therein, and said stop plug member is mounted to said main body by a retaining pin extending slidably through said center opening and secure to an apex of said conical top portion of said stop plug member.

3. A portable power plunger according to claim 2 including a tension spring mounted on said retaining pin and located between said cross bar and a top head of said retaining pin.

4. A portable power plunger comprising:

a cylindrical housing having a piston slidably located therein and mounted to an elongated solid stem extending outward through an upper cap of said housing, air release valve means formed in said upper cap and adapted to release air from said housing when said piston is operated in an up and down reciprocating fashion, an outlet formed at a lower end of said housing, attachment means adapted to be removably mounted to said outlet and operative to engage with a waste water opening of a clogged drain, a back flow preventor assembly mounted in said housing and located below said piston and adapted to prevent foul water from said drain to enter into said housing, an interior compartment in said housing and located between said piston and said outlet, an injector member integrally formed on said housing, said injector member having a lower tubular portion extending into said interior compartment, and an upper tubular portion extending outside said housing, a control valve mounted to said upper portion of said injector member, a coupling member mounted to said control valve and adapted to connect said control valve selectively to a pressurized water supply and pneumatic source by a flexible hose, a frusto-conical spud attachment member removably and interchangeably mounted at said outlet, said back flow preventor assembly including a cylindrical main body fixedly mounted to said housing, said main body having a bottom opening with a bevelled bottom edge, and a stop plug member located below said main body, said stop plug member having a conical top portion with a sloping top surface, and said sloping top surface and said bevelled bottom edge having an equal sloping gradient and adapted to engage one another in an intimate and tight contact.

5. A portable power plunger according to claim 4 wherein said main body has a transverse top cross bar with a center opening formed therein, and said stop plug member is mounted to said main body by a retaining pin extending slidably through said center opening and secure to an apex of said conical top portion of said stop plug member.

6. A portable power plunger according to claim 5 including a tension spring mounted on said retaining pin and located between said cross bar and a top head of said retaining pin.

7. A portable power plunger according to claim 6 wherein said lower tubular portion of said injector member has a lower end located adjacent to and above said outlet.

8. A portable power plunger according to claim 7 wherein said spud attachment member is removably mounted to said outlet through an angled elbow coupling.

9. A portable power plunger according to claim 8 wherein said coupling member mounted to said control valve is an L-shaped coupling member.

10. A portable power plunger according to claim 9 wherein said L-shaped coupling member is secured to said housing by a brace member.

* * * * *